US009750375B2

(12) United States Patent
Byun

(10) Patent No.: US 9,750,375 B2
(45) Date of Patent: Sep. 5, 2017

(54) SINK SPLASH GUARD AND SECURING DEVICE

(71) Applicant: Muhyun Byun, Bucheon-si (KR)

(72) Inventor: Muhyun Byun, Bucheon-si (KR)

( * ) Notice: Subject to any disclaimer, the term of this patent is extended or adjusted under 35 U.S.C. 154(b) by 0 days.

(21) Appl. No.: 15/124,033

(22) PCT Filed: Dec. 4, 2014

(86) PCT No.: PCT/KR2014/011802
§ 371 (c)(1),
(2) Date: Sep. 7, 2016

(87) PCT Pub. No.: WO2015/133708
PCT Pub. Date: Sep. 11, 2015

(65) Prior Publication Data

US 2017/0014003 A1 Jan. 19, 2017

(30) Foreign Application Priority Data

Mar. 7, 2014 (KR) ..... 10-2014-0027450

(51) Int. Cl.
*A47J 47/20* (2006.01)
*E03C 1/181* (2006.01)

(52) U.S. Cl.
CPC ..... *A47J 47/20* (2013.01); *E03C 1/181* (2013.01)

(58) Field of Classification Search
CPC ..... A47J 47/20; E03C 1/181
(Continued)

(56) References Cited

U.S. PATENT DOCUMENTS 1,355,086 A * 10/1920 Beebe ..... A47J 47/20 4/658
1,408,812 A * 3/1922 Leighton ..... A47J 47/20 4/658

(Continued)

FOREIGN PATENT DOCUMENTS

KR 10-2010-0009440 1/2010
KR 20-0451677 12/2010

(Continued)

OTHER PUBLICATIONS

International Search Report and the Written Opinion Dated Jan. 26, 2015 From the Korean Intellectual Property Office Re. Application No. PCT/KR2014/011802 and Its Translation of Search Report Into English.

*Primary Examiner* — Huyen Le

(57) ABSTRACT

Hitherto, when securing splash guards, same have been secured by means of a securing device on the inside of the bowl of the sink, but this has been inconvenient in that securing the bottom edge of the splash guard to the top edge of the sink rim been ensured through the use of two-sided tape or suckers or the like, and, since the inside of the bowl is very wet, a substantial amount of grime and bacteria and the like occurs on the securing device of the splash guard which is on the inside of the bowl, and, additionally, water seeps in between when a splash guard has been secured to the top edge of the sink rim, such that the article frequently drops off and does not stick well. The present invention relates to a sink splash guard and securing device which is provided on a sink and guards against water that splashes when washing dishes, and the present invention is adapted such that, when the splashguard is secured to a sink, the securing device is able to secure the splashguard to the front-side wall of the sink rim, where there is no wetness, rather than the inside of the bowl, and thus is adapted such (Continued)

that same does not fall off even in long-term use and, additionally, the invention is adapted such that the width of the securing device (3) can be adjusted so as to allow most possible uses despite the fact that domestic sinks have different widths (13).

2 Claims, 8 Drawing Sheets

(58) Field of Classification Search
USPC ..... 4/658
See application file for complete search history.

(56) References Cited

U.S. PATENT DOCUMENTS

| | | | | | |
|---|---|---|---|---|---|
| 4,878,257 | A * | 11/1989 | Hardin | E03C 1/181 | 4/520 |
| 2014/0373269 | A1 * | 12/2014 | Murray | E03C 1/186 | 4/658 |

FOREIGN PATENT DOCUMENTS

| | | |
|---|---|---|
| KR | 10-1062093 | 9/2011 |
| KR | 10-2013-0056523 | 5/2013 |
| WO | WO 2015/133708 | 9/2015 |

* cited by examiner

SINK SPLASH GUARD AND SECURING DEVICE

RELATED APPLICATIONS

This application is a National Phase of PCT Patent Application No. PCT/KR2014/011802 having International filing date of Dec. 4, 2014, which claims the benefit of priority of Korean Patent Application No. 10-2014-0027450 filed on Mar. 7, 2014. The contents of the above applications are all incorporated by reference as if fully set forth herein in their entirety.

FIELD AND BACKGROUND OF THE INVENTION

The present invention relates to a sink splashboard which is installed on a sink and blocks splashing water at the time of washing dishes, and more particularly to a sink splashboard in which a securing device securing the splashboard to the top of the sink is secured to the front side of the sink, which is opposite to a wet bowl side, and the securing device.

So far, a splashboard is secured to the inside of the bowl of a sink by means of a securing device or is secured by using a double-sided tape, a sucker or the like such that the lower portion of the splashboard is secured to the top of a sink rim.

Since the inside of the bowl is very wet, a large amount of grime, germs, etc., occur on the securing device of the splashboard, which is inside the bowl. Also, since the splashboard is secured to the top of the sink rim, water penetrates between the splashboard and the sink, so that the splashboard is frequently removed and does not adhere well.

SUMMARY OF THE INVENTION

The present invention relates to a sink splashboard which is installed on a sink and blocks splashing water at the time of washing dishes, and a securing device. The purpose of the present invention is to secure the splashboard to the dry front wall of the sink rim instead of to the inside of the bowl through the securing device, so that the splashboard is not removed even though it is used for a long time.

The present invention relates to a sink splashboard which is installed on a sink and blocks splashing water at the time of washing dishes, and a securing device securing the splashboard.

In order to secure a sink splashboard 1 on a sink rim 4, an upper securing device 5 is vertically formed to form the upper portion of the securing device 3.

At the top of the upper securing device 5, an upper catching protrusion 6 is formed to protrude to the right in such a manner as to catch a securing portion 2 of the splashboard 1 from above the sink rim 4. At least one upward securing protrusion 7 is formed on a lower portion of the upper securing device 5 such that the upward securing protrusion 7 faces a downward securing protrusion 11. Elastic grooves 8 are formed on both sides of the upward securing protrusion 7 in order to give elasticity to the upward securing protrusion 7.

A lower securing device 9 is vertically formed to form the upper portion of the securing device 3. At the bottom of the lower securing device 9, a lower catching protrusion 10 is formed to protrude to the right such that a lower portion of the securing device 3 is secured in a sink receiving upper groove 12.

In order that the upward securing protrusion 7 of the upper securing device 5 and the downward securing protrusion 11 of the lower securing device 9 are secured to and engaged with each other in accordance with a sink width 13, at least two downward securing protrusions 11 are vertically formed on the lower securing device 9 in such a manner as to face the upward securing protrusion 7.

Advantageous Effects

Since the sink splashboard 1 is secured to the front wall of the sink instead of to the inside of the bowl or on the sink, there is no possibility that grime, germs, etc., occur on the securing device, and the securing device can be hygienically and strongly secured for a long time and be conveniently used without considering that the splashboard is frequently removed and does not adhere well due to water penetrating between the splashboard and the top of the sink rim.

Also, even if the sink widths 13 in respective homes are different, the width of the securing device 3 can be adjusted to be used in the sinks as many as possible.

DESCRIPTION OF SPECIFIC EMBODIMENTS OF THE INVENTION

Figure 1:
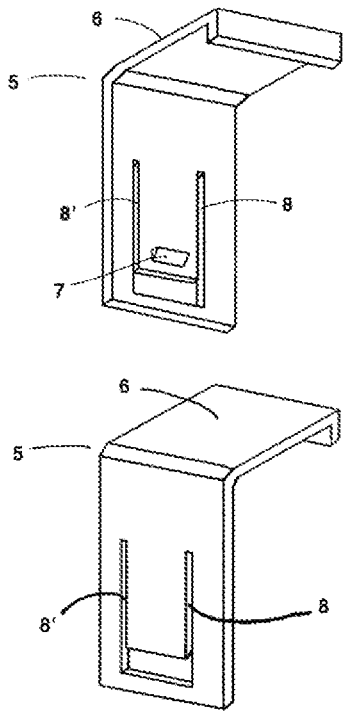
FIG. 1 is a perspective view of an upper securing device 5 of the present invention.
Figure 2:
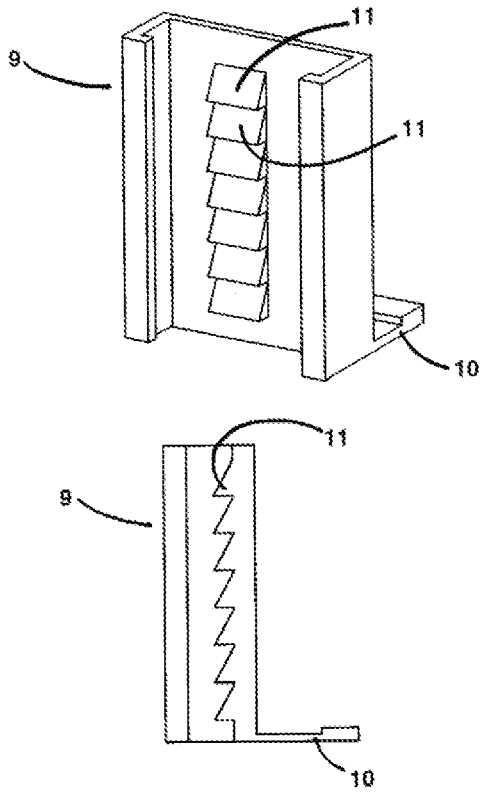
FIG. 2 shows a perspective view and a cross sectional view of a lower securing device 9 of the present invention.

The present invention will be described in detail as follows with reference to the accompanying drawings.

In order to secure a sink splashboard 1 on a sink rim 4, an upper securing device 5 is vertically formed to form the upper portion of the securing device 3.

At the top of the upper securing device 5, an upper catching protrusion 6 is formed to protrude to the right in such a manner as to catch a securing portion 2 of the splashboard 1 from above the sink rim 4. At least one upward securing protrusion 7 is formed on the lower portion of the upper securing device 5 such that the upward securing protrusion 7 faces a downward securing protrusion 11. Elastic grooves 8 are formed on both sides of the upward securing protrusion 7 in order to give elasticity to the upward securing protrusion 7.

A lower securing device 9 is vertically formed to form the upper portion of the securing device 3. At the bottom of the lower securing device 9, a lower catching protrusion 10 is formed to protrude to the right such that the lower portion of the securing device 3 is secured in a sink receiving upper groove 12.

In order that the upward securing protrusion 7 of the upper securing device 5 and the downward securing protrusion 11 of the lower securing device 9 are secured to and engaged with each other in accordance with a sink width 13, at least two downward securing protrusions 11 are vertically formed on the lower securing device 9 in such a manner as to face the upward securing protrusion 7.

This will be described in detail based on the cross sectional views showing the operations of the securing device of FIGS. 3, 4, and 5.

Figure 3:
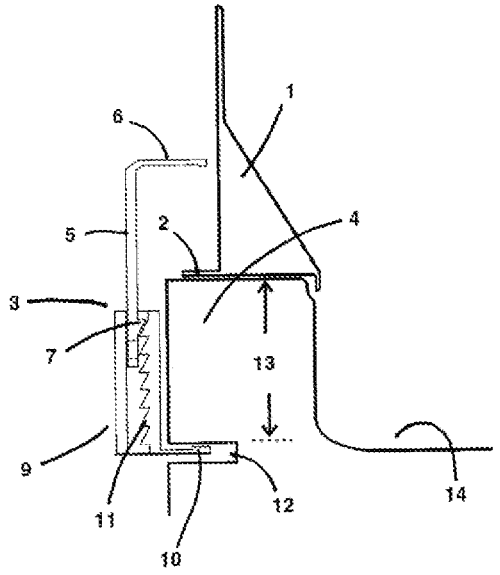
FIG. 3 is a cross sectional view showing an operation 1 of the present invention.

First, as shown in FIG. 3, the splashboard 1 is placed on the sink rim 4. The lower portion of the upward securing protrusion 7 of the upper securing device 5 is coupled from above the downward securing protrusion 11 of the lower securing device 9 and then the upper catching protrusion 6 is placed on the splashboard securing portion 2 on the sink rim 4. Then, the lower catching protrusion 10 at the bottom of the lower securing device 9 is pushed into the sink receiving upper groove 12, and the upper catching protrusion 6 of the upper securing device 5 is pressed in the direction of the arrow (A) of FIG. 4 such that the lower catching protrusion 10 is secured in accordance with the thickness of the sink. Simultaneously with this, the lower catching protrusion 10 is upwardly pushed toward the sink rim 4.

Figure 4:
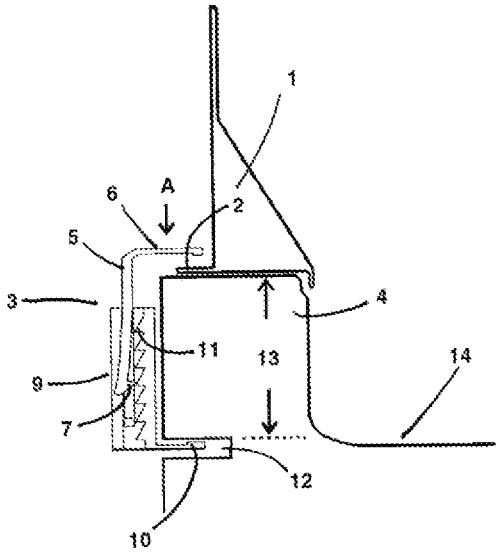
FIG. 4 is a cross sectional view showing an operation 2 of the present invention.
Figure 5:
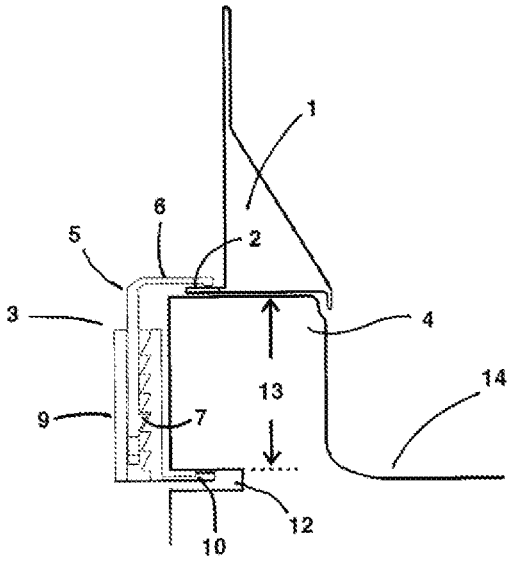
FIG. 5 is a cross sectional view showing an operation 3 of the present invention.
Figure 6:
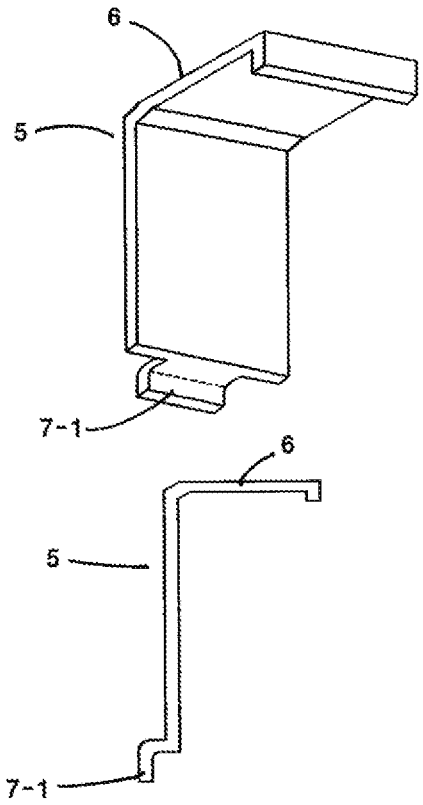
FIG. 6 is a perspective view of an upper securing device 5-1 according to another embodiment of the present invention.
Figure 7:
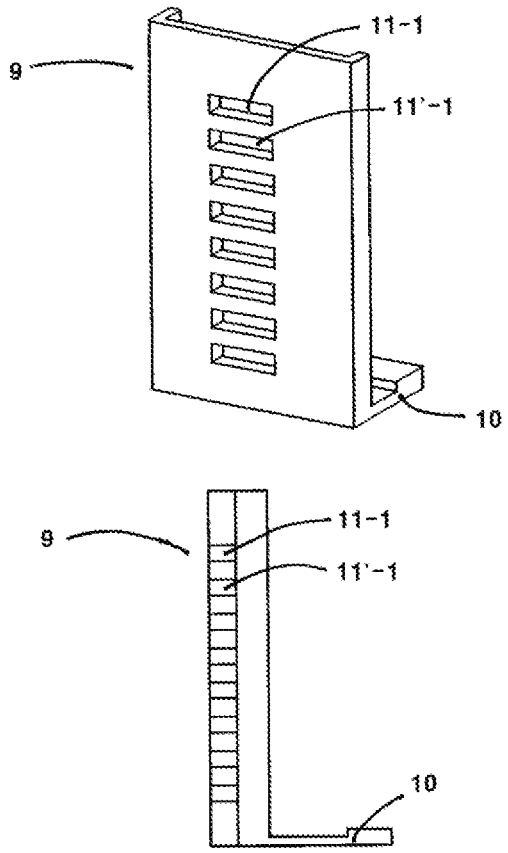
FIG. 7 shows a perspective view and a cross sectional view of a lower securing device 9-1 according to another embodiment of the present invention.
Figure 8:
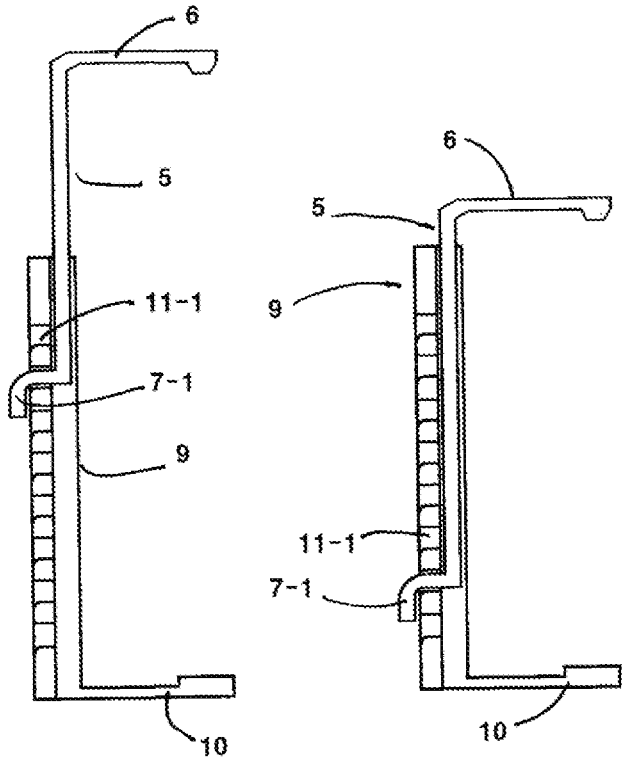
FIG. 8 is a cross sectional view showing an operation of a securing device 3-1 according to another embodiment of the present invention.
Figure 9:
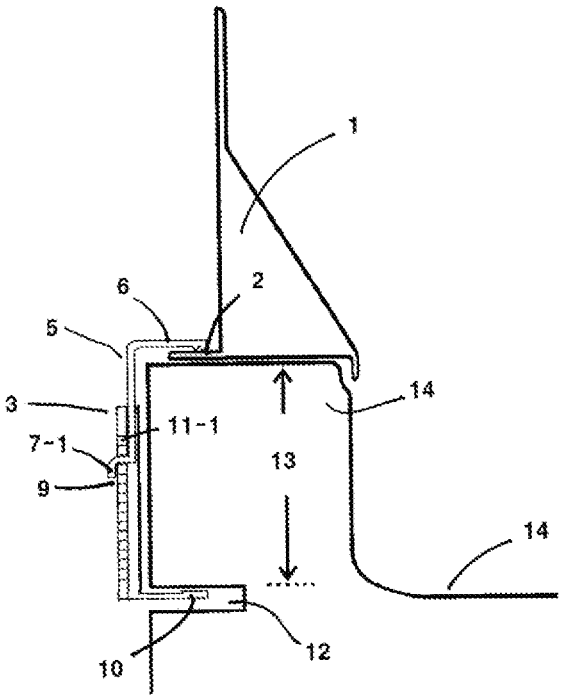
FIG. 9 is a cross sectional view showing that installation has been completed in accordance with another embodiment of the present invention.

As shown in FIG. 4, the upward securing protrusion 7 is pushed backward at the protruding portion of the downward securing protrusion 11 by elasticity and is coupled at the concave portion repeatedly. When the upward securing protrusion 7 reaches a position corresponding to the sink width 13, the splashboard is, as shown in FIG. 5, secured to the sink.

This intends that even if the sink widths 13 in respective homes are different, the width of the securing device 3 can be adjusted to be used in the sinks as many as possible.

For another embodiment,

At least one securing catcher 7-1 is formed in correspondence with the upward securing protrusion 7 and the elastic groove 8, and at least two securing grooves 11-1 are formed in correspondence with the downward securing protrusion 11.

When the securing catcher 7-1 is inserted into and secured to the position of the securing groove 11-1 in accordance with the sink width 13, the splashboard is secured through the adjustment depending on the sink width 13.

What is claimed is:

1. A sink splashboard which is installed on a sink and blocks splashing water at the time of washing dishes, and a securing device securing the splashboard, wherein an upper securing device (5) is vertically formed to form an upper portion of the securing device (3) in order to secure a sink splashboard (1) on a sink rim (4), wherein, at the top of the upper securing device (5), an upper catching protrusion (6) is formed to protrude to the right in such a manner as to catch a securing portion (2) of the splashboard (1) from above the sink rim (4), wherein at least one upward securing protrusion (7) is formed on a lower portion of the upper securing device (5) such that the upward securing protrusion (7) faces a downward securing protrusion (11), wherein elastic grooves (8) are formed on both sides of the upward securing protrusion (7) in order to give elasticity to the upward securing protrusion (7), wherein a lower securing device (9) is vertically formed to form the upper portion of the securing device (3), wherein, at the bottom of the lower securing device (9), a lower catching protrusion (10) is formed to protrude to the right such that a lower portion of the securing device (3) is secured in a sink receiving upper groove (12), and wherein, in order that the upward securing protrusion (7) of the upper securing device (5) and the downward securing protrusion (11) of the lower securing device (9) are secured to and engaged with each other in accordance with a sink width (13), at least two downward securing protrusions (11) are vertically formed on the lower securing device (9) in such a manner as to face the upward securing protrusion (7).

2. The sink splashboard and the securing device of claim 1, wherein at least one securing catcher (7-1) is formed in correspondence with the upward securing protrusion (7) and the elastic groove (8), and at least two securing grooves (11-1) are formed in correspondence with the downward securing protrusion (11), and wherein, when the securing catcher (7-1) is inserted into a position of the securing groove (11-1) in accordance with the sink width (13), the splashboard is secured.

* * * * *